United States Patent [19]

Reno

[11] Patent Number: 4,775,460

[45] Date of Patent: Oct. 4, 1988

[54] HYDROCRACKING PROCESS WITH FEED PRETREATMENT

[75] Inventor: Mark E. Reno, Villa Park, Ill.

[73] Assignee: UOP, Inc., Des Plaines, Ill.

[21] Appl. No.: 137,697

[22] Filed: Dec. 24, 1987

[51] Int. Cl.[4] ..... C10G 67/06

[52] U.S. Cl. ..... 208/91; 208/46; 208/49; 208/108; 208/112; 585/320

[58] Field of Search ..... 208/46, 49, 85, 88, 208/91, 108, 112; 585/320, 431, 436

[56] References Cited

U.S. PATENT DOCUMENTS

| | | | |
|---|---|---|---|
| 2,796,387 | 6/1957 | Schmidt | 208/88 |
| 3,238,123 | 3/1966 | Voorhies et al. | 208/46 |
| 3,619,407 | 11/1971 | Hendricks et al. | 208/48 R |
| 3,623,973 | 11/1971 | Tarhan | 208/108 |
| 3,691,063 | 9/1972 | Kirk, Jr. | 208/91 |
| 3,767,563 | 10/1973 | Woodle | 208/85 |
| 4,203,825 | 5/1980 | Kmak et al. | 585/320 |
| 4,366,047 | 12/1982 | Winter et al. | 208/49 |
| 4,411,768 | 10/1983 | Unger et al. | 208/59 |
| 4,447,315 | 5/1984 | Lamb et al. | 208/99 |
| 4,608,153 | 8/1986 | Hudson et al. | 208/112 |
| 4,618,412 | 10/1986 | Hudson et al. | 208/59 |
| 4,624,776 | 11/1986 | Long et al. | 208/91 |
| 4,634,516 | 1/1987 | Haskell et al. | 208/91 |
| 4,661,239 | 4/1987 | Steigleder | 208/111 |

*Primary Examiner*—Anthony Mc Farlane

*Attorney, Agent, or Firm*—Thomas K. McBride; John F. Spears, Jr.

[57] ABSTRACT

Problems associated with the formation of polycyclic aromatic compounds within hydrocracking reaction zones are reduced by a feed pretreating sequence which comprises first contacting the feed with a metal-free alumina to produce polycyclic compounds or their precursors followed by their removal by contacting the feed with a bed of adsorbent such as charcoal. The feed pretreatment steps are operated at an elevated temperature but at a very reduced pressure and preferably substantially free of hydrogen.

12 Claims, 1 Drawing Sheet

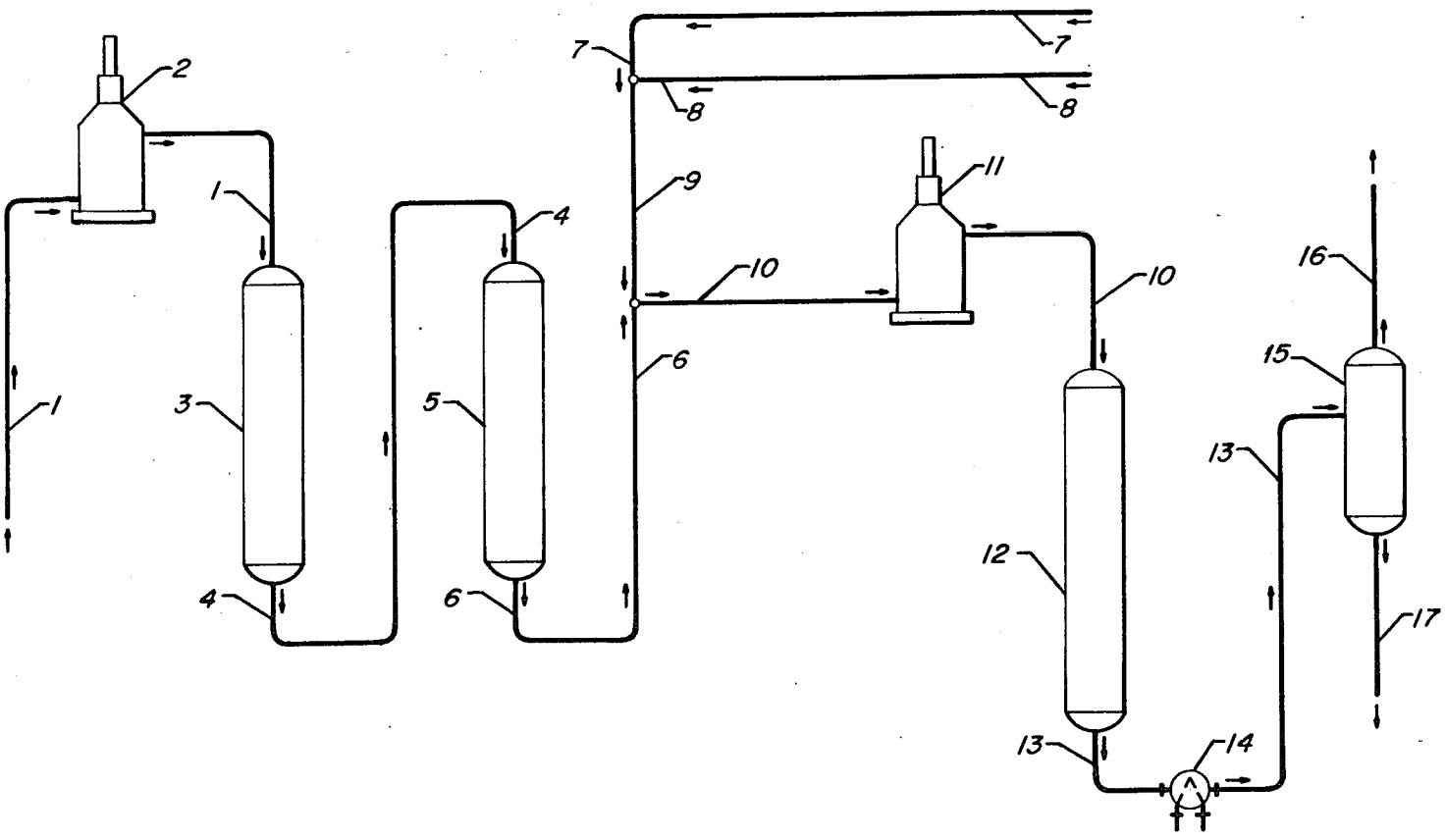
1
2
1
3
4
4
5
6
6
7
8
9
10
10
11
12
13
13
14
15
16
17
7
8

HYDROCRACKING PROCESS WITH FEED PRETREATMENT

FIELD OF THE INVENTION

The invention relates to that process employed in petroleum refineries referred to as a hydrocracking process. The invention therefore relates to a process wherein a broad boiling point range mixture of hydrocarbons such as a vacuum gas oil is contacted with a hydrocracking catalyst in admixture with hydrogen for the purpose of converting at least a portion of the charge material into hydrocarbons having a lower average molecular weight. The subject invention is specifically directed to pretreatment steps which occur prior to the passage of the feedstream and hydrogen into contact with the hydrocracking catalyst. The subject invention is directly concerned with a method for counteracting the formation and deposit of polycyclic aromatic compounds, which compounds tend to form during certain hydrocracking processes and may accumulate within downstream processing equipment causing effects detrimental to the operation of the hydrocracking process.

PRIOR ART

Hydrocracking processes are well developed and are used commercially in a number of petroleum refineries for the conversion or upgrading of mixtures of hydrocarbons to more valuable products. Hydrocracking may be employed for the conversion of a light material such as a naphtha to lighter materials such as LPG if market conditions dictate but is more normally applied to the conversion of a relatively heavy or residual material such as a vacuum gas oil to gasoline or diesel fuel. A specific example of a hydrocracking process intended for the production of middle distillates is provided in U.S. Pat. No. 4,661,239 issued to K. Z. Steigleder, which is incorporated herein by reference.

U.S. Pat. No. 3,619,407 issued to G. W. Hendricks et al. is relevant both for its teaching in regards to the operation of a hydrocracking process and the composition of a hydrocracking catalyst suitable for use therein but also in that it discloses the problem addressed by the subject invention. Specifically, this reference describes the formation of polycyclic aromatic hydrocarbons within the hydrocracking reaction zone, with these compounds being characterized as benzocoronenes in this reference. The reference indicates it is known that these compounds have a limited solubility in the effluent of the hydrocracking zone and may tend to build up in residual or heavy recycle streams present in the process. The reference also indicates these materials may tend to deposit or "plate out" in cooler portions of the overall process flow such as the surface of heat exchangers used to cool a liquid stream containing these materials. The solution to this problem presented by this reference is the withdrawal of a small bleed stream of benzocoronene rich material from the reactor effluent.

U.S. Pat. No. 4,447,315 issued to P. R. Lamb et al. is relevant for its teaching in regard to another solution to the same problem, the formation of polycyclic or polynuclear aromatic compounds (PNA's) within the reaction zone. This reference teaches that the problem may be overcome by passing the recycle stream produced by fractionating the liquid phase material recovered from the reactor effluent through a bed of suitable adsorbent such as activated carbon or alumina. The deleterious polycyclic materials are thereby removed from the recycle stream at a rate sufficient to prevent their concentration from reaching the level at which serious problems occur due to these materials plating out or depositing on the surfaces of process equipment.

U.S. Pat. No. 4,618,412 issued to C. W. Hudson et al. and U.S. Pat. No. 4,411,768 issued to H. Unger et al. are both believed relevant for their teaching of the removal or hydrotreating of the PNA's (polynuclear aromatics) or coke precursors from recycle streams of hydrocracking and hydrogenation reaction zones respectively.

U.S. Pat. No. 4,624,776 issued to R. B. Long et al. describes a process wherein coke precursors are removed from atmospheric and vacuum resids by contacting the feedstock with an adsorbent. U.S. Pat. No. 3,691,063 issued to M. C. Kirk, Jr. is believed pertinent for its teaching of a process wherein the feed to a hydrocracker is passed through a guard zone wherein the feedstream is contacted with a material which reduces the metal and asphalt content of the feedstream. The material taught for this use is alumina or one of the various acid cracking catalysts such as silica alumina or a zeolite.

BRIEF SUMMARY OF THE INVENTION

The invention is an improved hydrocracking process characterized by the removal of precursors for the formation of polycyclic aromatics (also referred to as PNA's) prior to the passage of the feedstream into the hydrocracking reaction zone. This removal is accomplished in a two-step procedure. The first step of the removal procedure comprises contacting the feedstream with a material which promotes the formation of the polycyclic aromatic hydrocarbons at conditions of elevated temperature but which preferably are mild (low pressure) relative to hydrocracking conditions. The second step in this procedure is the removal of the polycyclic aromatic hydrocarbons produced in the first step by contacting the effluent of the first step with an absorbent material such as activated charcoal. The thus treated feed material may then be heated, pressurized and admixed with hydrogen and contacted with the hydrocracking catalyst at hydrocracking conditions.

A broad embodiment of the invention may be characterized as a hydrocracking process which comprises the steps of passing a feedstock comprising an admixture of hydrocarbons having boiling points above 204 degrees C. through a first treating zone maintained at a superatmospheric pressure and a temperature of from about 260 to about 375 degrees C., with the feedstock contacting a bed of porous metal oxide particles under conditions which cause the formation of polycyclic aromatic compounds but result in essentially no cracking reactions and producing a first effluent stream substantially similar to the feedstock and having a higher concentration of polycyclic aromatic compounds than the feed stream; contacting the first effluent stream with a bed of treating particles comprising charcoal in a second treating zone maintained at conditions which promote the retention of the polycyclic aromatic compounds on said treating particles and producing a second effluent stream substantially similar to the feedstock but having a lower concentration of the polycyclic aromatic compounds than said first effluent stream; passing the second effluent stream into a hydrocracking reaction zone maintained at hydrocracking conditions which include a temperature of from about 375 to about 510 degrees C., a pressure above 3500 kPa g, a hydrogen to hydrocarbon mole ratio above 1.0:1.0 and the presence of a hydrocracking catalyst and producing a hydrocracking reaction zone effluent stream; and recovering a hydrocracking process product stream from said reaction zone effluent stream.

BRIEF DESCRIPTION OF THE DRAWING

The Drawing is a simplified process flow diagram of a preferred embodiment of the invention wherein hydrocracking feed from line 1 is passed in series flow through a bed of alumina 3 and a bed of activated carbon 5 maintained at an elevated temperature and is then heated, pressurized, and passed into the hydrocracking reaction zone 12.

DETAILED DESCRIPTION

As evidenced by the references cited above, specifically the U.S. patents to G. W. Hendricks et al. and P. R. Lamb et al. a processing problem may occur when it is attempted to hydrocrack a heavy or residual oil such as a vacuum gas oil. This problem often arises when the hydrocracking catalyst comprises a zeolitic component as described in more detail below but may also arise in the absence of this component. The process tends to produce a small amount of high molecular weight polycyclic aromatic compounds, commonly referred to as PNA's or benzocoronenes. These materials may plate out or foul various parts of the refining equipment as they have a very low solubility level in the product hydrocarbon. They tend to accumulate on the cold surfaces of heat exchangers used to recover heat from the effluent of the hydrocracking reaction zone. The coating caused by PNA deposits decreases the efficiency of the heat recovery step and may lead to undesirably high pressure drops within the heat exchanger. At an extreme the deposits may require termination of the processing in order to clean the heat exchangers.

The terms "polycyclic aromatic hydrocarbons", "PNA's", and "polynuclear aromatics" are used interchangeably herein to refer to the heavy aromatic hydrocarbons having nine or more "benzene rings" and which are produced in the hydrocracking reaction zone. These compounds have been characterized as benzocoronenes in the Hendricks reference cited above.

The number of rings in these materials is often used to aid in their classification. The exact cut point in defining the minimum number of rings in a PNA as compared to a PNA precursor is open to debate. However, it has been determined that 11-plus ring compounds are the most detrimental in terms of plating out and catalyst deactivation. The concentration of heavier compounds having 9 or more rings per molecule, especially 11-plus ring molecules, is believed to be most important in correlating PNA concentration in recycle or product streams with surface fouling and catalyst deactivation mechanism rates. Lighter polycyclics having 4–8 rings per molecule are referred to herein as "PNA precursors".

Although not ascertained with certainty, it appears that the rate of formation of these compounds in the hydrocracking reaction zone is quite low and that the problems mentioned above basically arise when the process entails the production of a recycle stream containing heavy hydrocarbons recovered from the effluent of the hydrocracking zone. The PNA production is believed to occur continuously despite the presence of minor amounts of PNA's in the recycle. Newly produced PNA's accumulate in a heavy bottoms recycle stream and the concentration in the reactor effluent therefore increases with time. The prior art has therefore apparently concentrated on methods of removing the offensive materials from this recycle stream to prevent their buildup within the process. For instance, in the process of Hendricks a small slip stream is removed to control the buildup or concentration of these compounds in the recycle stream. In the process of Lamb, the recycle stream is passed through adsorption zones wherein the polycyclic compounds are removed by adsorption onto a bed of solid particulate matter, such as activated carbon.

It is an objective of the subject invention to provide a hydrocracking process for heavy hydrocarbon feedstreams having a lowered requirement for the removal of polycyclic aromatic hydrocarbons from heavy recycle streams present in the process. It is another objective of the subject invention to provide a method of removing precursors for the formation of such polycyclic aromatic hydrocarbons from the feedstream to a hydrocracking process and to thus reduce the rate of formation of polycyclic aromatic hydrocarbons within a hydrocracking reaction zone. It is a further objective to reduce the rate of hydrocracking catalyst deactivation. It is also an objective of the subject invention to reduce or eliminate any requirement for the treating of high pressure and high temperature liquid phase recycle streams by instead performing a less costly, low pressure treating operation, and to thereby reduce the overall cost of dealing with the problem of polycyclic aromatic hydrocarbon formation.

The subject invention achieves these objectives by performing an upstream treating operation to remove the materials which tend to form the polycyclic aromatic hydrocarbons prior to the passage of the hydrocracking feedstream into the reaction zone. The subject invention is illustrated in the Drawing, wherein a feedstream comprising a vacuum gas oil is passed through a fired heating zone 2 via line 1. The heated vacuum gas oil stream should have a temperature of from 500°–700° F. (260°–371° C.) and a mildly superatmospheric pressure, such as a pressure of 50 psig (345 kPa g). The heated feedstream is then passed through a fixed bed of metal-free alumina catalyst base retained within the first treating zone 3. This contacting step results in the formation of large quantities of polycyclic aromatic hydrocarbons. However, there is essentially no hydrocracking, hydrogenation or hydrodemetallization of the feedstock performed during this contacting step. The effluent stream of the first treating zone 3 will therefore be highly similar to the feedstream of line 1 but will have an increased content of the polycyclic aromatic hydrocarbons.

The effluent stream of the first treating zone is passed through line 4 into a second treating zone 5. The second treating zone comprises a fixed bed of small diameter particulate activated carbon and is maintained at substantially the same pressure and temperature as the first treating zone. Although the second treating zone could be operated at different conditions, such as a reduced temperature, the first and second treating zone are preferably operated at the same conditions of temperature and pressure except for whatever temperature and pressure differences result from the transportation of the process streams between the two zones and unavoidable pressure or temperature changes within the treating zones themselves. Within the second treating zone, the effluent of the first treating zone is contacted with the activated charcoal or other adsorbent in a manner which results in the selective separation of the polycyclic aromatic hydrocarbons from the vacuum gas oil boiling range hydrocarbons and the accumulation of these polycyclic compounds on the activated carbon. There is thus formed a second treating zone effluent stream removed through line 6 which has essentially the same composition as the feedstream of line 1 but has a much reduced concentration of polycyclic aromatic as compared to the first treating zone effluent stream of line 4.

Fresh or makeup hydrogen from line 7 is combined with a recycle stream of line 8, preferably containing an admixture of recycled hydrogen-rich gas and any recycled hydrocarbons, with these two streams being transported through line 9 to the junction of line 6. The resultant admixture of the vacuum gas oil and hydrogen is passed through line 10 into a second fired heating means 11. A second heating means may not be required in all instances. Its function is to heat the resultant admixture to the desired inlet temperature of the downstream hydrocracking reaction zone 12. The heated material flowing through line 10 is treated in a conventional manner in the hydrocracking reaction zone 12 by contacting it with one or more beds of a solid hydrocracking catalyst maintained at hydrocracking conditions. Although a fixed bed downflow operation is illustrated in the Drawing, those skilled in the art will appreciate that numerous other types of hydrocracking reaction zones could be used in place of this design.

The effluent stream of the hydrocracking reaction zone will comprise an admixture of converted hydrocarbons, unconverted hydrocarbons, by-product light gases and residual unused hydrogen but will have a lower concentration of polycyclic aromatic hydrocarbons than prior art processes. The effluent stream of the hydrocracking reaction zone is passed via line 13 through a first heat exchange means 14. The function of this heat exchange means is to recover heat from the effluent stream as by exchange against the feedstream to the process. The cooling which occurs in the heat exchange means 14 also promotes the separation in the flash vessel 15 of the effluent into a liquid phase hydrocarbon stream removed in line 17 and a vapor phase stream removed in line 16.

The material of line 17 will normally be passed into a second separation stage operated at a lower pressure. The liquid phase stream remaining after this second separation step is passed into one or more fractionation columns such as a stripping column and a product fractionation column and separated into various boiling point ranges such as gasoline, diesel fuel, and unconverted bottoms material. The vapor phase stream of line 16 will customarily be further cooled and passed into one or more vapor-liquid separation stages for the recovery of additional product hydrocarbons and to increase the hydrogen content of the ultimately recovered vapor phase stream. Typically a major portion of the vapor phase stream is recycled to the reaction zone to conserve hydrogen while a minor portion may be discharged to balance the production of light hydrocarbons. It is also known that the recycle gas stream may be passed through a treating step as for the removal of sulfur compounds.

In the embodiment depicted in the Drawing no hydrogen is commingled with the feedstream of line 1. That is, the feedstream to the first treating zone is substantially free of uncombined hydrogen, with this term meaning that no hydrogen is intentionally added to the feed and that only residual dissolved hydrogen which may be present due to upstream treating operations is present in the feedstream. Those skilled in the art will recognize the possibility of admixing some hydrogen into the feedstream of line 1. However, it is preferred that the concentration of chemically uncombined or free hydrogen in the material entering the first and second treating zones is less than 30 standard cubic feet per barrel (5.8 meters$^3$ per meter$^3$). This is because it is believed that a low hydrogen partial pressure promotes PNA formation. The material flowing through the first and second treating zones will therefore normally be totally liquid phase material, whereas in the hydrocracking zone there will be vapor phase material due to the high amount of hydrogen circulated through the hydrocracking zone.

The ability to reduce the formation of polycyclic aromatic hydrocarbons in the reaction zone and to reduce their concentration in process streams of a hydrocracking unit has advantages other than the prevention of fouling of heat exchange surfaces. These same materials also tend to deactivate the catalyst. Therefore, by removing polycyclic aromatic hydrocarbons from the initial feedstream and by reducing the tendency for their formation within the reaction zone, the average concentration of these materials in the fluids contacting the hydrocracking catalyst is reduced. The result is that a lower amount of catalyst is required in the hydrocracking zone to allow stable operation for the same length of time as compared to when these materials are present. The same operating advantage can be used in other manners as by providing the ability to operate at a higher severity during a run or cycle of the same length. Alternatively, rather than increasing the severity of operation conditions the process may be adapted to processing feedstreams which place a greater demand upon the catalyst system and would normally tend to result in a shorter catalyst life.

The first treating zone will preferably contain a particulate solid which for hydrocracking purposes would be considered noncatalytic. That is, the solid material employed within the first treating zone should have essentially no or perhaps at most miniminal activity as a hydrocracking catalyst. Preferably, the particulate material is highly porous in nature and is present in the form of small particles such as spheres or extrudates having sizes roughly equivalent to that employed for hydrocracking catalyst. Preferably, the particulate material comprises a porous metal oxide, with an alumina-based compound being highly preferred. The presence of small amounts of other amorphous materials or of zeolitic materials is acceptable if they do not tend to adversely effect the functionality of the particulate material for selectively promoting the formation of polycyclic hydrocarbons.

These treating materials of the first zone should be substantially free of any catalytic metal component, a term used herein to refer to the metals normally deposited on a support material of a catalyst to improve the activity or selectivity of the final catalyst composite. The treating materials will therefore preferably contain less than 0.2 weight percent of a metal component, with the metals of the metal component normally being chosen from the group consisting of such metals as iron, cobalt, molybdenum, nickel, tungsten, and the platinum group metals. The treating material will preferably have a surface area greater than 150 meters$^2$ per gram and a pore volume greater than 0.4 grams per cc. One highly preferred treating particle for use in the first treating zone comprises an alumina hydrocracking catalyst base material having a significant percentage, at least 20%, of pores greater than 300 A in diameter. By base material, it is meant that this is the material on which the metal component of a hydrocracking catalyst is deposited during the preparation of a hydrocracking catalyst. This material will preferably contain at least 80 weight percent alumina and preferably 90 weight percent alumina.

The second treating zone will also contain a finely divided particulate material. The function of this material however is the accumulation or adsorption of the polycyclic aromatic hydrocarbons produced in the first treating zone. Accordingly, it preferably has essentially no ability to promote the production or formation of these compounds. The material employed in the second treating zone is therefore an essentially inert adsorbent. The size and configuration of the particulate material of this treating zone is chosen on the basis of pressure drop and flow considerations through the treating zone, surface area, and treating capacity related to the size of the particle and finally those dictates imposed by commercial availability and costs. A wide variety of materials are known to function as an adsorbent for the polycyclic aromatic hydrocarbons, with these materials including various silica gels, large pore aluminas, and various charcoals and other carbon-based materials. Preferably, the treating particles are rich in carbon. Charcoals therefore comprise a preferred adsorbent. Of the charcoals those which are substantially free of metals such as those derived from coconuts or other low metal content organic material are preferred. A highly preferred material for the second treating zone is a large pore activated carbon. This material has proven to be very effective for selectively separating polycyclic aromatic hydrocarbons from a vacuum gas oil boiling range material. Commercially available activated charcoal has been found to work effectively.

Six commercially available carbons were tested for the removal of 11+ ring PNA's from a typical recycle liquid of a gas oil hydrocracking process. All of the carbons were capable of treating at least 100 volumes of liquid before they failed to remove additional amounts of PNA's. The four carbons which exhibited best performance, of over 600 volumes of oil processed, were sold under the brand names of Norit RO 0.8, Calgon CAL, Calgon CPG and Nachar WV-L. These materials share a common characteristic of having a high surface area in the larger pores having a radius greater than 200 Angstroms. This surface area should be at least 0.5 sq. m/cc. The amount of total surface area of the charcoals does not seem to be determinative of its adsorptive capacity for 11+ ring PNA's.

The treating zones are operated at relatively mild conditions of temperature and pressure as compared to the hydrocracking zone. These mild conditions allow the use of less expensive pressure vessels and piping thereby increasing the commercial feasibility of the overall process. The treating zones are preferably operated within a pressure range of 50 to about 500 psig (345– 3447 kPa g) and at a temperature of about 250 to about 600 degrees F. (121 to 316 degrees C.) with temperatures above 500 degrees F. (260 degrees C.) being highly preferred. The treating zones may be of approximately equal volume. However, as the second zone functions to adsorb PNA's its useful onstream life is limited by the adsorptive capacity of the adsorbent. Therefore the second zone is preferably operated at a lower space velocity. A broad range of liquid hourly space velocities (L.H.S.V.) for each of the two individual zones is from 0.1 to 2.5 $hr^{-1}$. A preferred range of space velocities is from 0.4 to 1.5 $hr^{-1}$. Representative space velocities are 1.0 $hr^{-1}$ for the first zone and 0.5 $hr^{-1}$ for the second zone.

The hydrocracking catalyst may be prepared using starting material having the essential X-ray powder diffraction pattern of zeolite Y set forth in U.S. Pat. No. 3,130,007. The starting material may be modified by techniques known in the art which provide a desired form of the zeolite. Thus, modification techniques such as hydrothermal treatment at increased temperatures, calcination, impregnation, or reaction with an acidity strength inhibiting specie, crystallization and any combination of these are contemplated. The Y-type zeolite preferred for use in the present invention will possess a unit cell size between about 24.20 Angstroms and 24.45 Angstroms. Preferably, the zeolite unit cell size will be in the range of about 24.20 to 24.40 Angstroms and most preferably about 24.30 Angstroms.

The hydrocracking catalyst composite should comprise between 2 wt. % and 20 wt. % of a Y-type zeolite, and preferably between 2 wt. % and 10 wt. %. The catalyst composition should also comprise a porous refractory inorganic oxide matrix which may form between 2 and 98 wt. %, and preferably between 5 and 95 wt. % of the support of the finished catalyst composite. The matrix may comprise any known refractory inorganic oxide such as alumina, magnesia, silica, titania, zirconia, silica-alumina and the like and combinations thereof.

A preferred matrix comprises silica-alumina or alumina. The most preferred matrix comprises a mixture of silica-alumina and alumina wherein said silica-alumina comprises between 5 and 45 wt. % of said matrix. It is also preferred that the support comprises from about 5 wt. % to about 45 wt. % alumina.

The silica-alumina component may be produced by any of the numerous techniques which are rather well defined in the prior art relating thereto. Such techniques include the acid-treating of a natural clay or sand, coprecipitation or successive precipitation from hydrosols. These techniques are frequently coupled with one or more activating treatments including hot oil aging, steaming, drying, oxidizing, reducing, calcining, etc. The pore structure of the support or carrier commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical pH or by treating the carrier with various inorganic or organic reagents.

A finished catalyst for utilization in the subject hydrocracking process should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2$/gm are greatly preferred.

The alumina component of the hydrocracking catalyst may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The precise physical characteristics of the catalyst such as shape and surface area are not considered to be limiting upon the utilization of the present invention. The catalyst may, for example, exist in the form of pills, pellets, granules, broken fragments, spheres, or various special shapes such as trilobal extrudates, disposed as a fixed bed within a reaction zone. Alternatively, the catalyst may be prepared in a suitable form for use in moving bed reaction zones in which the hydrocarbon charge stock and catalyst are passed either in countercurrent flow or in co-current flow, or in fluidized-solid processes in which the charge stock is passed upward through a turbulent bed of finely divided catalyst, or in the suspension process, in which the catalyst is slurried in the charge stock and the resulting mixture is conveyed into the reaction zone. The charge stock may be passed through the reactor(s) in the liquid or mixed phase, and in either upward or downward flow.

The catalyst particles may be prepared by any known method in the art including the well-known oil drop and extrusion methods. In the case of the oil drop method, catalyst particles may be prepared by first suspending the selected zeolite powder in a suitable sol. Active metal components may also be incorporated into the sol. The sol admixture may then be passed as droplets into an oil bath which is maintained at an elevated temperature and retained in the oil bath until the sol droplets set to gelled spheres. The spherical particles may then be withdrawn from the oil bath and thereafter aged in a suspending medium at an elevated temperature for a suitable time period. The spherical particles may then be dried and calcined. If an alumina or silica-alumina oxide matrix is desired, the oil drop method may be carried out in accordance with U.S. Pat. No. 2,620,314 or 3,003,972, respectively, the teachings of which are incorporated herein by reference.

A preferred method of preparing a catalyst for use in the present invention is to simultaneously co-mull the selected zeolite with both alumina and amorphous silica-alumina. After mulling, the admixture is extruded through a die having suitable openings such as circular openings so as to produce an extrudate material of cylindrical shape. The extrudate can be cut in $\frac{1}{2}$ to $\frac{1}{4}$ inch lengths and then dried and calcined at elevated temperatures and conditions known in the art.

Although the hydrogenation components may be added before or during the oil drop or extrusion methods, hydrogenation components are preferably composited with the catalyst by impregnation after the selected zeolite and refractory inorganic oxide materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on the preparation of suitable hydrocracking may be obtained by reference to U.S. Pat. Nos. 4,422,959; 4,576,711; 4,661,239; 4,686,030; and, 4,695,368 which are incorporated herein by reference.

Hydrogenation components contemplated are those catalytically active components selected from Group VIB and Group VIII metals and their compounds. Generally, the amount of hydrogenation components present in the final catalyst composition is small compared to the quantity of the other above-mentioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated include one or more metals chosen from the group consisting of molybdenum, tungsten, chromium, iron, cobalt, nickel, platinum, palladium, iridium, osmium, rhodium, rudinium and mixtures thereof.

The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the catalyst. Usually phosphorus is present in the catalyst in the range of 1 to 30 wt. % and preferably 3 to 15 wt. % calculated as $P_2O_5$. In addition, boron may also be present in the catalytic composite.

The subject process is especially useful in the production of middle distillate fractions boiling in the range of about 300°-700° F. (149°-371° C.) as determined by the appropriate ASTM test procedure. In addition, it is expected that useful hydrogenation reactions such as hydrodenitrification and hydrodesulfurization will occur simultaneously with hydrocracking of heavier feedstocks. Typical feedstocks include virtually any heavy mineral or synthetic oils and fractions thereof. Thus, such feedstocks as straight run gas oils, vacuum gas oils, demetallized oils, atmospheric residue, deasphalted vacuum residue, coker distillates, cat cracker distillates, shale oil, tar sand oil, coal liquids, and the like are contemplated. The preferred feedstock will have a boiling point range starting at a temperature above 160° Celsius. Preferred feedstocks include gas oils having at least 50% volume of their components boiling above 700° F. (371° C.). The hydrocracking feedstock may contain nitrogen usually present as organonitrogen compounds in amounts between 1 ppm and 1.0 wt. %. The feed will normally contain sulfur containing compounds sufficient to provide a sulfur content greater than 0.15 wt. %. It may also contain mono- and/or polynuclear aromatic compounds in amounts of 80 volume percent and higher.

Hydrocracking conditions employed in the subject process are those customarily employed in the art for hydrocracking processes. Hydrocracking reaction temperatures are in the range of 400° to 1200° F. (204°-649° C.), preferably between 600° and 950° F. (316°-510° C.). Reaction pressures are in the range of atmospheric to about 3,500 psig (24,132 kPa g), preferably between 200 and 3000 psig (1379-20,685 kPa g). Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178-8,888 std. $m^3/m^3$), preferably between 2,000 and 30,000 scf per barrel of charge (355-5,333 std. $m^3/m^3$).

The reaction zone effluent of a hydrocracking process is normally removed from the catalyst bed, subjected to partial condensation and vapor-liquid separation and then fractionated to recover the various components thereof. The hydrogen, and if desired some or all of the unconverted heavier materials, are recycled to the reactor. Conventional product recovery schemes are therefore suitable for use with the subject invention.

The following examples are provided for illustrative purposes and are not intended to limit the scope of the present invention.

TABLE 1

| | Hydrocracker Stream Properties | |
|---|---|---|
| | Feed | Effluent |
| API | 20.1 | 40 |
| IBP (°F.) | 648 (339° C.) | 90 (32° C.) |
| 50% pt | 793 (426° C.) | 610 (321° C.) |
| EP | 1000 (538° C.) | 910 (487° C.) |
| Sulfur, wt. % | 1.71 | <0.01 |
| Nitrogen, wt. % | 0.16 | <0.01 |

A staged (not simultaneous series flow) simulation of a commercial operation is performed using pilot plant scale equipment. This is based on work which was done separately on each individual step. For comparison purposes a vacuum gas oil feed having the properties listed in Table 1 is processed to yield an overall liquid product as also described in Table 1. The same feed is then treated in accordance with the invention by passage over an all alumina hydrocracking catalyst base at a temperature of 550 degrees F. (288 degrees C.) an L.H.S.V. of 1.0 $hr^{-1}$ and a pressure of 100 psig (689 kPa g). The concentration of PNA precursors in the feed stream is approximately 200 wt. ppm and the 11+ ring PNA concentration is not detectable. The concentration of PNA precursors in the effluent of the first treating zone is below the minimum level of detection of the analytical method employed, while the level of 11+ ring PNA's has increased to approximately 200 wt. ppm. The effluent of the first treating zone is passed through a bed of fresh activated charcoal (Calgon CAL) maintained at the same temperature and pressure as the first treating zone but at an L.H.S.V. of 0.5 $hr^{-1}$. This results in the concentration of PNA's being reduced to below detection limits. The effluent of the second treating zone is then hydrocracked in the same manner and produces a product essentially equal in properties to the product of the reference run set out in the Table. The major difference is that the effluent of the reference run contains about 200 wt. ppm of PNA's while the effluent produced using the subject treating steps contains less than 50 wt. ppm PNA's. Therefore the subject invention is shown to greatly decrease the PNA content of the hydrocracker effluent.

WHAT IS CLAIMED:

1. A hydrocracking process which comprises the steps:

(a) passing a feedstock comprising an admixture of hydrocarbons having boiling points above 204 degrees C. through a first treating zone maintained at conditions of superatmospheric pressure and a temperature of from about 260 to about 375 degrees C., with the feedstock contacting a bed of porous metal oxide particles under said conditions which cause the formation of polycyclic aromatic compounds but result in essentially no cracking reactions and producing a first effluent stream substantially similar to the feedstock and having a higher concentration of polycyclic aromatic compounds than the feed stream;

(b) contacting the first effluent stream with a bed of treating particles comprising charcoal in a second treating zone maintained at conditions which promote the retention of the polycyclic aromatic compounds on said treating particles and producing a second effluent stream substantially similar to the feedstock but having a lower concentration of the polycyclic aromatic compounds than said first effluent stream;

(c) passing the second effluent stream into a hydrocracking reaction zone maintained at hydrocracking conditions which include a temperature of from about 375 to about 510 degrees C., a pressure above 3500 kPa g, a hydrogen to hydrocarbon mole ratio above 1.0:1.0 and the presence of a hydrocracking catalyst and producing a hydrocracking reaction zone effluent stream; and, (d) recovering a hydrocracking process product stream from said reaction zone effluent stream.

2. The process of claim 1 further limited in that hydrogen is admixed into said second effluent stream prior to passage of the second effluent stream into the hydrocracking reaction zone.

3. The process of claim 2 further limited in that the porous metal oxide particles present in the first treating zone are substantially free of any catalytically active metal component which promotes hydrocracking wherein said metal component does not form an integral part of the support component of said particles.

4. The process of claim 3 further limited in that the porous metal oxide particles present in the first treating zone comprise alumina.

5. The process of claim 3 further limited in that the porous metal oxide particles present in the first treating zone comprise a material used as a support material for the hydrocracking catalyst present in the hydrocracking reaction zone.

6. The process of claim 2 further limited in that the feedstock and the first effluent stream contain substantially no uncombined hydrogen.

7. The process of claim 1 further limited in that the first and the second treating zone are operated at substantially the same conditions of temperature and pressure, and in that the pressure in the first and second treating zones is less than 2800 kPa g.

8. The process of claim 7 further limited in that the first effluent stream contains substantially no uncombined hydrogen and in that the porous metal oxide particles present in the first treating zone consist essentially of alumina.

9. A hydrocracking process which comprises the steps:

(a) passing a feedstock comprising an admixture of hydrocarbons having boiling points above 204 degrees C. and which is substantially free of uncombined hydrogen through a first treating zone maintained at conditions of superatmospheric pressure and a temperature of from about 260 to about 375 degrees C., with the feedstock contacting a bed of porous metal oxide particles comprising alumina under said conditions which cause the formation of polycyclic aromatic compounds but result in essentially no cracking reactions and producing a first effluent stream substantially similar to the feedstock and having a higher concentration of polycyclic aromatic compounds than the feed stream;

(b) contacting the first effluent stream with a bed of treating particles comprising charcoal in a second treating zone maintained at conditions which promote the retention of the polycyclic aromatic compounds on said treating particles and producing a second effluent stream which is substantially free of uncombined hydrogen and is substantially similar to the feedstock but having a lower concentration of the polycyclic aromatic compounds than said first effluent stream;

(c) passing the second effluent stream and hydrogen into a hydrocracking reaction zone maintained at hydrocracking conditions which include a temperature of from about 375 to about 510 degrees C., a pressure above 3500 kPa g, a hydrogen to hydrocarbon mole ratio above 1.0:1.0 and the presence of a hydrocracking catalyst and producing a hydrocracking reaction zone effluent stream; and, (d) recovering a hydrocracking process product stream from said reaction zone effluent stream.

10. The process of claim 1 further limited in that the first and the second treating zone are operated at substantially the same conditions of temperature and pressure, and in that the pressure in the first and second treating zones is less than 2800 kPa g.

11. The process of claim 10 further limited in that the porous metal oxide particles present in the first treating zone are substantially free of any catalytically active metal component which promotes hydrocracking wherein said component does not form an integral part of the support component of said particles.

12. The process of claim 11 further limited in that the porous metal oxide particles present in the first treating zone comprise a material used as a support material for the hydrocracking catalyst present in the hydrocracking reaction zone.

* * * * *